US005446704A

United States Patent [19]

Chen

[11] Patent Number: 5,446,704

[45] Date of Patent: Aug. 29, 1995

[54] STRUCTURE OF CLOCK

[76] Inventor: Ching-Ti Chen, Chang-hua County, Taiwan

[21] Appl. No.: 377,056

[22] Filed: Jan. 23, 1995

[51] Int. Cl.[6] ..... G04B 17/02

[52] U.S. Cl. ..... 368/134; 368/165

[58] Field of Search ..... 368/134–138, 368/165–166, 179–183

[56] References Cited

U.S. PATENT DOCUMENTS

| | | | |
|---|---|---|---|
| 2,323,796 | 7/1943 | Coce | 368/134 |
| 4,378,166 | 3/1983 | Itami et al. | 368/134 |
| 4,613,236 | 9/1986 | Nakamura | 368/165 |
| 4,829,495 | 5/1989 | Kaneko et al. | 368/134 |

*Primary Examiner*—Vit W. Miska

[57] ABSTRACT

A structure of clock comprises a main body having a clock mechanism on upper portion, a battery and circuit chamber on medial portion, a pendulum chamber on lower portion and an oscilatory control device on the top thereof. The pendulum has a tubular member at the top having a pair of corresponding right triangular recesses formed at two ends respectively, which are made in registry with the right triangular support members on the oscilatory control device. Because the right triangular support members are sizely smaller than that of the right triangular recesses, it is characterized in that when the triangular recesses suspend from the triangular support members, the oscilatory span of the pendulum is restricted by the oscilatory device.

2 Claims, 3 Drawing Sheets

STRUCTURE OF CLOCK

BACKGROUND OF THE INVENTION

The present invention relates to clocks, more particularly to a specially designed pendulum clock in which a simplized mechanism has been provided to restrict the oscilating angle of the pendulum.

Prior art pendulum clock (as shown in FIG. 1) generally comprises a main body 10 and a pendulum 20. The main body 10 has an upper housing 11 for receiving the clock mechanism therein, a lower housing 12 for receiving the pendulum 20, a pendulum support member 13 on the top of the clock and a battery chamber 14 at a medium between the upper and lower housings 11 and 12. A cover 15 is provided to accomodate with the support member 13. The pendulum 20 has a tubular member 21 on the top, a bracket 22 at lower end for retaining a megnetic block 23 therein, and a bob member 15 suspended from a holder 24 under the bracket 22. When the pendulum 20 is assembled to the support member 13 and enclosed by the cover 15 therein, the tubular member 21 thereof will be rotatably secured at two ends therein respectively by the corresponding cylinder members 131 and 151 of the support member 13 and the cover 15. A variable circuit under the clock mechanism will actuates the pendulum 20 oscilating laterally within the lower housing 12. A pair of damper tabs 111 and 112 laterally disposed on the back side of the housing for preventing the pendulum 20 from over oscilating. However, this arrangement causes a great disadvantage of making noise therein.

SUMMARY OF THE PRESENT INVENTION

The present invention has a main object to provide a structure of clock of which uses a simplified mechanism to control the oscilatory angle of the pendulum.

Accordingly, the structure of clock according to the present invention comprises generally a main body, a pendulum and an oscilatory angular control mechanism for pendulum. Wherein, the oscilatory angular control mechanism includes a suspender chamber and a lid member, a laterally inclined support member of right triangle cross-section centrally formed on the corresponding position of the chamber and the lid member, such that the bottom of the right triangles are arcuated. In cooperation with the late,,rally inclined support members, on the chamber and the lid member, a tubular member has been interally formed on the top of the pendulum, in which a recess of triangular cross-section at each end thereof. The character of this invention is that the triangular cross-sections of the recesses are sizely larger than that of the support members so that the support members are loosely engaged with the recesses therein in order to control the oscilatory angle of the pendulum in predetermined span.

The present invention will become more fully understood by reference to the following detailed description thereof, when read in accompanying with the attached drawings.

DETAIL DESCRIPTION OF THE PREFERRED EMBODIMENT OF THE PRESENT INVENTION

Figure 1:
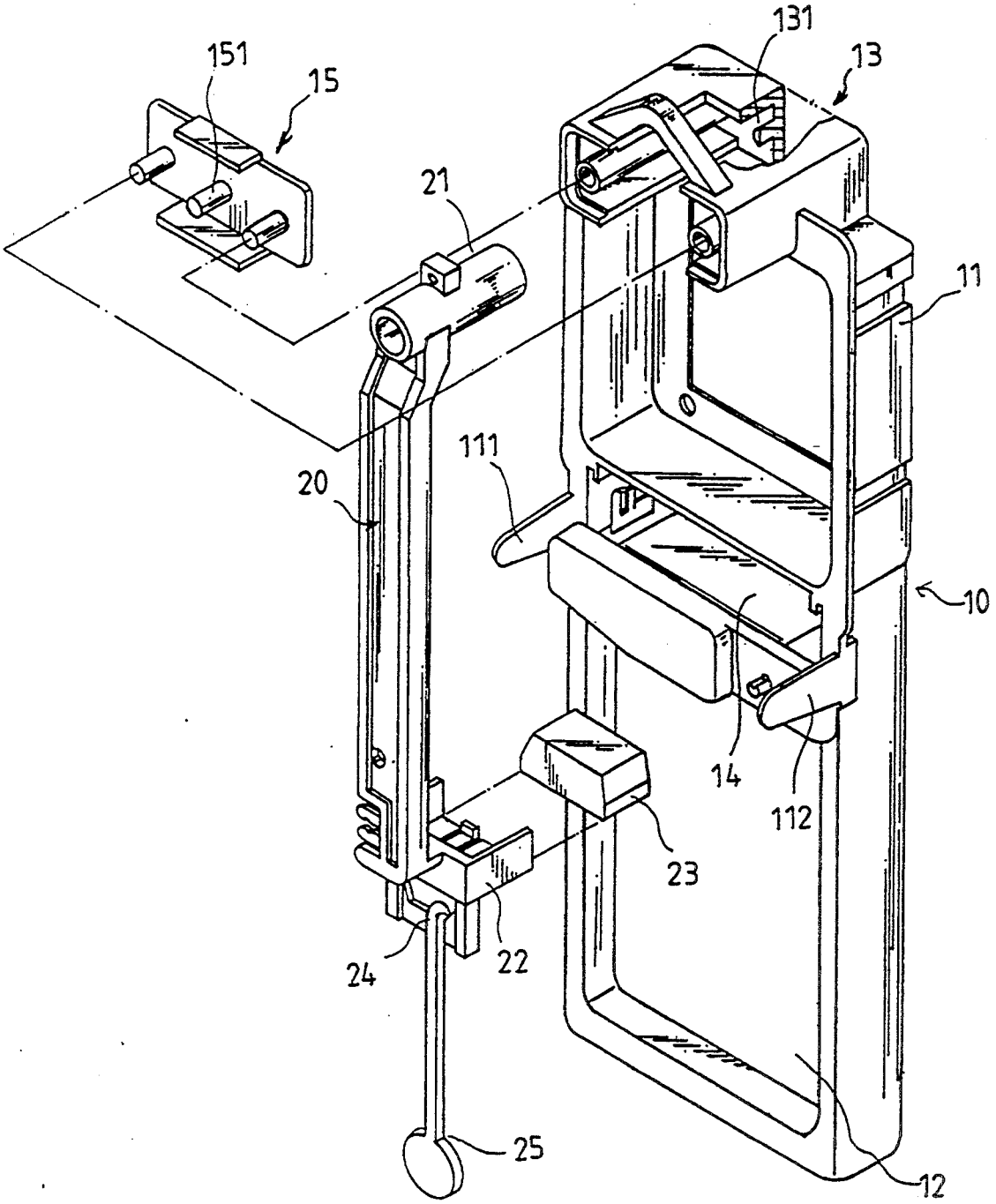
FIG. 1 PRIOR ART
FIG. 1 is an exploded perspective view to show a pendulum clock according to the prior art.
Figure 2:
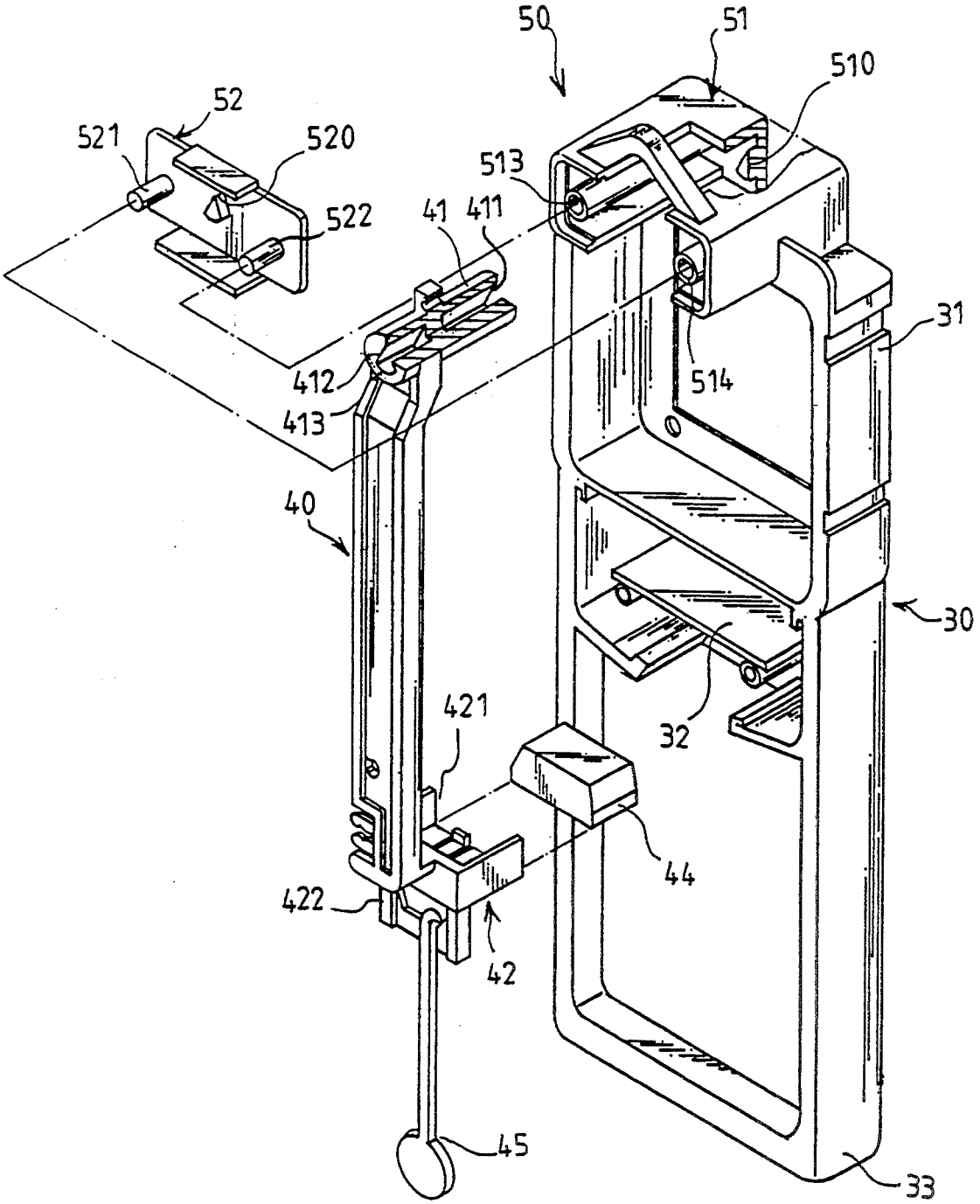
FIG. 2 is an exploded perspective view to show the preferred embodiment according to the present invention.

Referring to FIG. 2, the structure of clock of the present invention comprises generally a main body 30, a pendulum member 40 and an oscilatory control device 50, wherein, the main body includes a first chamber 31 on the upper portion for disposing the clock mechanism therein (not shown), a second chamber 32 on medial portion thereof underneath the first chamber 31 for disposing batteries and electrical circuit therein and a third chamber 33 on the lower portion for receiving the pendulum 40 therein. The pendulum 40 has a tubular member 41 perpendicularly formed on the top, a retainer 42 on the lower end thereof having a rack 421 for receiving a magnetic piece 44 and a holder 422 for suspending from a bob 45. The tubular member 41 has a pair of corresponding right triangular recesses 411 and 412 respectively formed at two ends therein, the triangular recesses 411 and 412 have better an arcuate bottom 413. The oscilatory control device 50 on the top of the main body 10 is a less dimensional housing 51 with the rear end thereof slightly protruded backward relating to the main body 10 having a pair of tubular retainers 513 and 514 near the lateral walls respectively and a first support member 510 of right triangular cross-section centrally projected outward from inside the front wall of the housing 51 and a rectangular lid member 52 which is made in concomitance with the housing 51 having a corresponding second support member 520 of right triangular cross-section centrally formed on the inward surface in registry with the first support member 510 and a pair of cylinder rods 521 and 522 protruded parallel to the second support member 520 from near the lateral edge thereof in registry with the pair of the tubular retainers 513 and 514 of the housing 51 respectively. The first and the second support member 510 and 520 are of identical dimension and an arcuate bottom and sizely smaller than the triangular recesses 411 and 412. When the support members 510 and 520 engage with the triangular recesses 411 and 412, a predetermined space will be left between them as to allow the pendulum to oscilate laterally within a limited span (as shown in FIG. 3).

Figure 3:
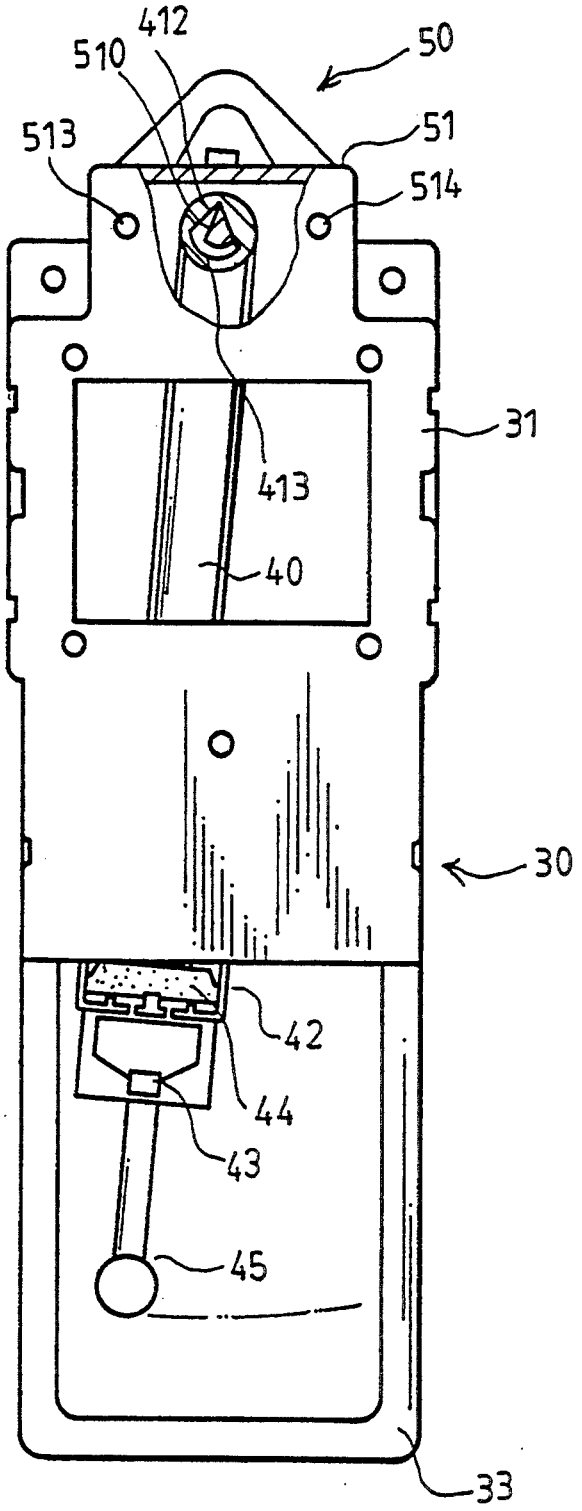
FIG. 3 is an elevational plane view from the rear side of the preferred embodiment according to the present invention.

Referring to FIG. 3, when assembly, firstly mount the pendulum 40 onto the housing 51 therein on the top of the main body 30 by loosely engaging the triangular recess 411 thereof onto the first support member 510, then insert the second support member 520 of the rectangular lid member 52 into the triangular recess 412 of the pendulum 40 so as the pair of the cylinder rods 521 and 522 insert into their respective tubular retainers 513 and 514 simultaneously. You will see that the pendulum 40 has been loosly supported by the pair of the first and the second support members 510 and 520 of the oscilatory control device 50 in a predetermined angle of oscilation. When the pendulum activated by the electrical circuit moves right wards, the left side of the triangular recesses 411 and 412 will be stopped against the right side of the first and second supprt members 510 and 520 as the pendulum reachs to a certain span of oscilation, and vis-a-visa, so that the oscilatory angle of the pendulum has been strictly controlled by the support members 510 and 520, without needing a pair of damper tabs as it were for the prior art. Therefore, preventing the clock from making noise.

Note that the specification relating to the above embodiment should be construed as to be exemplary rather than as to limitative of the present invention, with many variations and modifications being readily attainable by a person of average skill in the art without departing from the spirit or scope thereof as defened by the appended claims and their legal equivalents.

I claim:

1. A structure of clock comprising:

a main body, said body including a first chamber on the upper portion for disposing a clock mechanism therein, a second chamber on the medial portion for disposing batteries and electrical circuit therein a third chamber on the lower portion thereof for receiving a pendulum therein and a oscilatory control device on the top thereof;

said pendulum comprising a tubular member perpendicularly formed on the top thereof having a pair of corresponding right triangular recesses of arcuate bottom respectively formed at two ends therein and a retainer at the lower end thereof including a means for receiving a magnetic piece and a means for holding a bob member;

said oscilatory control device comprising a less dimensional housing slightly protruded backward from said main body having a pair of parallel extended tubular retainers near the lateral walls of said housing and a first support member of right triangular cross-section smaller in size than the dimension of said right triangular recesses, centrally protruded from the inward surface of the front wall thereof;

a lid member in concomitance with said oscilatory control device, said lid member comprising a pair of cylinder rods parallel extended from the inward surface and positionally in registry with said tubular retainers of said housing, and second support member of right triangular cross-section centrally pretruded from the inward surface thereof in registry with said first support member of said housing;

whereby, said pendulum is mounted to said oscilatory control device by loosely suspending said right triangular recesses at two ends of said tubular member from said first and second support members of said housing and said lid member respectively when said cylinder rods of said lid member engage with said tubular retainers of said housing respectively.

2. A structure of clock according to claim 1, wherein said triangular recesses have an arcuate bottom.

* * * * *